US005853944A

United States Patent [19]

Foucher et al.

[11] Patent Number: 5,853,944

[45] Date of Patent: Dec. 29, 1998

[54] TONER PROCESSES

[75] Inventors: Daniel A. Foucher, Toronto; Raj D. Patel; Guerino G. Sacripante, both of Oakville; Walter Mychajlowskij, Mississauga, all of Canada

[73] Assignee: Xerox Corporation, Stamford, Conn.

[21] Appl. No.: 6,612

[22] Filed: Jan. 13, 1998

[51] Int. Cl.[6] ..... G03G 9/087

[52] U.S. Cl. ..... 430/137

[58] Field of Search ..... 430/137

[56] References Cited

U.S. PATENT DOCUMENTS

| | | | |
|---|---|---|---|
| 4,137,188 | 1/1979 | Uetake et al. | 430/106.6 |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,593,807 | 1/1997 | Sacripante et al. | 430/137 |
| 5,648,193 | 7/1997 | Patel et al. | 430/137 |
| 5,650,255 | 7/1997 | Ng et al. | 430/137 |
| 5,650,256 | 7/1997 | Veregin et al. | 430/137 |
| 5,658,704 | 8/1997 | Patel et al. | 430/137 |
| 5,660,965 | 8/1997 | Mychajlowskij et al. | 430/137 |

*Primary Examiner*—Roland Martin
*Attorney, Agent, or Firm*—E. O. Palazzo

[57] ABSTRACT

A process for the preparation of toner with a first aggregation of sulfonated polyester, and thereafter a second aggregation with a colorant dispersion and an alkali halide.

30 Claims, No Drawings

TONER PROCESSES

PENDING APPLICATIONS AND PATENTS

The following copending applications, the disclosures of which are totally incorporated herein by reference, are being filed concurrently herewith. The appropriate components and process parameters of the copending applications and patents may be selected for the present invention in embodiments.

U.S. Ser. No. 008,622 discloses a toner process wherein a colorant is flushed into a sulfonated polyester, followed by the addition of an organic soluble dye and an alkali halide solution.

U.S. Ser. No. 006,640 discloses a toner process wherein a latex emulsion and a colorant dispersion are mixed in the presence of an organic complexing agent or compound, and wherein the latex can contain a sodio sulfonated polyester resin.

U.S. Ser. No. 006,521 discloses an emulsion/aggregation/fusing process for the preparation of a toner containing a resin derived from the polymerization of styrene butadiene, acrylonitrile, and acrylic acid.

U.S. Ser. No. 006,553 discloses a toner process wherein there is mixed an emulsion latex, a colorant dispersion, and a monocationic salt, and wherein the resulting mixture possesses an ionic strength of about 0.001 molar to about 5 molar.

U.S. Ser. No. 006,299 discloses a toner process wherein there is mixed an emulsion latex and colorant dispersion, and wherein the colorant dispersion is stabilized with submicron sodio sulfonated polyester resin particles, and wherein the latex resin can be a sodio sulfonated polyester.

U.S. Ser. No. 006,742 discloses a toner process by blending an aqueous colorant dispersion with a latex blend containing a linear polymer and soft crosslinked polymer particles.

U.S. Ser. No. 006,742 discloses a toner process wherein there is mixed an aqueous colorant dispersion and an emulsion latex, followed by filtering, and redispersing the toner formed in water at a pH of above about 7 and contacting the resulting mixture with a metal halide or salt and then with a mixture of an alkaline base and a salicylic acid, a catechol, or mixtures thereof.

Also, illustrated in copending application U.S. Ser. No. 960,754, and U.S. Pat. No. 5,766,818, the disclosures of which are totally incorporated herein by reference, are cleavable surfactants and the use thereof in emulsionlaggregation/coalescence processes.

Illustrated in U.S. Pat. No. 5,658,704, the disclosure of which is totally incorporated herein by reference, is a process for the preparation of toner comprised of i) flushing pigment into a sulfonated polyester resin, and which resin has a degree of sulfonation of from between about 0.5 and about 2.5 mol percent based on the repeat unit of the polymer;

ii) dispersing the resulting pigmented sulfonated polyester resin in warm water, which water is at a temperature of from about 40° to about 95° C., and which dispersing is accomplished by a high speed shearing polytron device operating at speeds of from about 100 to about 5,000 revolutions per minute thereby enabling the formation of toner sized particles, and which particles are of a volume average diameter of from about 3 to about 10 microns with a narrow GSD;

iii) recovering said toner by filtration;

iv) drying said toner by vacuum; and v) optionally adding to said dry toner charge additives and flow aids.

Illustrated in U.S. Pat. No. 5,648,193, the disclosure of which is totally incorporated herein by reference, is a process for the preparation of toner compositions comprised of (i) flushing pigment into a sulfonated polyester resin, and which resin has a degree of sulfonation of from between about 2.5 and 20.0 mol percent based on the repeat unit of the polymer; (ii) dissipation of the resulting pigmented sulfonated polyester in water at about 40° to about 75° C. to obtain particles which are in the size range of about 50 to 200 nanometers; (iii) followed by cooling the resulting mixture below about the glass transition temperature of the sulfonated polyester; and adding, dropwise, a metal salt halide such as a magnesium chloride solution to form particles of a volume average diameter of from about 3 to about 10 microns with a narrow GSD; (iv) recovering the toner particles by filtration; (v) drying the toner particles by vacuum; and (vi) optionally adding to the dry toner particles charge additives and flow aids.

BACKGROUND OF THE INVENTION

The present invention is generally directed to toner processes, and more specifically, to aggregation processes for the preparation of toner resins, especially polyesters, and toner compositions thereof. In embodiments, the present invention is directed to the economical in situ, chemical or direct preparation of toners and toner resins comprising an initial preaggregation of submicron, for example equal to about 1 micron, or less than about one micron in average volume diameter, sized sulfonated polyester particles to a size about equal to that of the colorant dispersion, followed by a second aggregation to toner sized particles without the utilization of the known pulverization and/or classification methods, and wherein in embodiments toner compositions with an average volume diameter of from about 1 to about 25, and preferably from 1 to about 10 microns and narrow GSD of, for example, from about 1.16 to about 1.26 or about 1.18 to about 1.28 as measured on the Coulter Counter can be obtained, and which toners contain certain polyester resins, especially the sulfonated polyesters of the appropriate copending applications mentioned hereinbefore. The stepwise preparation of chemical toners enables, for example, additional process control of the aggregation, thereby reducing colorant rejection, and increasing the latitude of resins that can be aggregated with colorant, especially pigment. The resulting toners can be selected for known electrophotographic imaging methods, printing processes, including color processes, digital methods, and lithography. The process of the present invention in embodiments enables the utilization of polymers obtained by polycondensation reactions, such as polyesters, and more specifically, the sulfonated polyesters as illustrated in U.S. Pat. Nos. 5,348,832; 5,658,704 and 5,604,076, the disclosures of which are totally incorporated herein by reference, and which polyesters can be selected for low melting toners.

PRIOR ART

There is illustrated in U.S. Pat. No. 4,996,127 a toner of associated particles comprising primarily particles of a polymer with acidic or basic polar groups, and which toners can be prepared by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 are obtained. Other prior art may include U.S. Pat. Nos. 3,674,736; 4,137,188 and 5,066,560.

Emulsion/aggregation processes for the preparation of toners are illustrated in a number of patents, the disclosures of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners).

The appropriate processes and components of these patents may be selected for the present invention in embodiments thereof.

SUMMARY OF THE INVENTION

Examples of features of the present invention include:

A feature of the present invention relates to a sequential controlled aggregation of resin with a colorant to enable toners with predictable toner sizes and narrow GSDs.

It is another feature of the present invention to provide dry toner compositions comprised of a sulfonated polyester resin and colorant, and which toner is prepared by the initial aggregation of dispersed submicron sulfonated polyester particles to a larger, primary particle size, and the subsequent second aggregation of the polyester and toners thereof comprised, for example, of the sulfonated polyester and a colorant, such as pigment, dye, or mixtures thereof, and toner additives, such as charge additives, surface additives, and the like.

In another feature of the present invention there are provided simple and economical chemical processes for the stepwise preparation of lack and colored toner compositions with, for example, excellent colorant, such as pigment dispersion and narrow GSD.

Another feature of the present invention provides a simple sequential, such as a stepwise process for the preparation of toner size particles in the size range of from about 3 to about 7 microns with a narrow GSD in the range of from about 1.18 to about 1.26, and wherein the toner particles are comprised of a colorant, especially pigment and sulfonated polyester resin, and wherein for the processes there are selected alkali halides, such as beryllium chloride, beryllium bromide, beryllium iodide, magnesium chloride, magnesium bromide, magnesium iodide, calcium chloride, calcium bromide, calcium iodide, strontium chloride, strontium bromide, strontium iodide, barium chloride, barium bromide, barium iodide, and the like.

In a further feature of the present invention there is provided a process for the preparation of toner compositions with an average particle volume diameter of from between about 1 to about 20 microns, and preferably from abou1 I to about 9 microns, and with a narrow GSD of from about 1.12 to about 1.30, and preferably from about 1.14 to about 1.25 as measured by a Coulter Counter, and wherein the initial size of the aggregated sulfonated polyester particles are increased, for example, by about 4 to about 8 times, like from about 20 nanometers to about 150 nanometers, or alternatively from about 20 nanometers to about 150 to about 250 nanometers.

In another feature of the present invention there is provided a composite toner of sulfonated polymeric resin with colorant, such as pigment and optional charge control agent in high yields of from about 90 percent to about 100 percent by weight of toner without resorting to classification.

In yet another feature of the present invention there are provided toner compositions with low fusing temperatures of from about 110° C. to about 150° C. and with excellent blocking characteristics at from about 50° C. to about 60° C.

Moreover, in another feature of the present invention there are provided toner compositions with a high projection efficiency, such as from about 75 to about 95 percent efficiency as measured by the Match Scan II spectrophotometer available from Milton-Roy.

In a further feature of the present invention there are provided toner compositions which result in minimal, low or no paper curl.

These and other features of the present invention are accomplished in embodiments by the provision of toners and processes thereof. In embodiments of the present invention, there are provided processes for the preparation of toner compositions comprising a sulfonated polyester, and which processes comprise the preaggregation or initial aggregation of the sulfonated polyester, and thereafter effecting a second aggregation with a colorant, like a pigment dispersion.

Embodiments of the present invention relate to a process for the preparation of toner, which process comprises a first aggregation of predispersed submicron sulfonated polyester particles with an alkali halide, and thereafter a second aggregation of the larger submicron sulfonated polyester particles prepared in the first aggregation with a colorant dispersion and an alkali halide; a process for the preparation of toner which comprises a first aggregation of dispersed sulfonated polyester particles resulting in larger submicron sized particles, and thereafter a second aggregation of the resulting sulfonated polyester particles with a colorant dispersion and an alkali halide, and wherein the first aggregation is accomplished by the mixing and heating of the sulfonated polyester and a dicationic salt; and wherein the second aggregation comprises an additional heating and mixing wherein the larger submicron sulfonated polyester particles prepared in the first aggregation together with the colorant, wherein the colorant is a pigment; and the alkali halide is magnesium chloride; a process wherein the partially sulfonated polyester is dispersed from, for example, a 5 to about 50 weight percent solids content in warm water, from about 5° C. to about 15° C. above the polyester polymer glass transition, and there is formed submicron particles in the size range of, for example, from about 5 to about 80 nanometers, and wherein the first aggregation step which is accomplished by the addition of an alkali halide, such as $MgCl_2$, or similar dicationic salt solution (1 percent by weight in water) can occur prior or subsequent to heating to the optimum aggregation temperature of from about 35° C. to about 75° C., and which heating can be continued for from about 15 to about 480 minutes until the desired aggregate particle size is obtained, for example from about 70 to about 150 nanometers; effecting further aggregation of the resulting preaggregated latex with a dispersed colorant, such as pigment available from Sun Chemical, as an about 20 to about 50 weight percent of predispersed pigment dispersion in water with a mean pigment size in the range of from about 50 to about 150 nanometers; and further diluting with water, such as with 150 milliliters of dionized water, and the slow dropwise addition of about 50 milliliters of the alkali halide, such as $MgCl_2$ or similar dicationic solution, at or near the optimum aggregation temperature is accomplished. The aggregation progress can be monitored by both optical microscopy and Coulter Counter particle size measurements. Further, alkali halide, such as $MgCl_2$ or similar dicationic salt, can then be added and the temperature increased slightly, for example from about 0.2° C. to about 5° C., thereby permitting a more rapid aggregation. After a period of time, for example from about 30 minutes to about 5 hours, the desired final toner size, for example from about 4 to about 8 microns, and narrow particle size distribution (GSD), from about 1.1 to about 1.5, result.

The process of the present invention involves, for example, i) dispersing the sulfonated polyester resin in water, which water is at a temperature of from about 40° C. to about 95° C. and preferably between about 5° C. to about 15° C. above the polyester glass transition, and which dispersing is accomplished by a high speed shearing polytron device operating at speeds of from about 100 to about 5,000 revolutions per minute thereby enabling the formation of submicron sized particles, and which particles are of a volume average diameter of from about 5 to about 80 nanometers;

ii) an initial aggregation of the dispersed sulfonated polyester particles to submicron particles of from about 50 to about 200 nanometers, or more specifically, wherein the particles grow from about 5 to about 50 to about 200 nanometers, or from about 80 to about 90 to about 200 nanometers by the addition of a small amount of a solution containing a dicationic salt;

iii) adding a colorant like a pigment dispersion, available from Sun Chemical, as an about 20 to about 50 weight of predispersed pigment in water with a mean pigment size in the range of about 50 to about 150 nanometers, which dispersion is further diluted with, for example, about 150 to about 200 millimeters of DI (deionized) water, and wherein the aggregation rate can be controlled, for example, by the dropwise addition of alkali halide, such as a dicationic salt, from about 1 to about 150 milliliters, preferably, 1 percent by weight in water, and with heating near the optimum aggregation temperature, for example between about 40° C. to about 60° C., and preferably between about 48° C. and about 52° C., until optimum toner sized aggregates are obtained as monitored by both optical microscopy and Coulter Counter particle size measurements;

iv) optionally, but preferably recovering the toner, or toner particles by known methods, such as filtration; washing, and v) drying the toner particles with, for example, a vacuum; and vi) adding to the dry toner particles, or toner of resin and colorant, known toner additives, such as wax, as charge additives, surface flow additives, and the like. For the process, there can be selected various pigments, dyes, mixtures thereof, and the like, such as cyan, black, magenta, and yellow pigmented dispersions or mixtures thereof obtained, for example, as a predispersed form with, for example, from about 20 to about 60 weight percent of solids.

Disclosed is a process for the preparation of toner, which process comprises a first aggregation of sulfonated polyester and thereafter a second aggregation with a colorant dispersion and an alkali halide; a process for the preparation of toner, which process comprises a (1) first aggregation of dispersed sulfonated polyester particles and thereafter a (2) second aggregation thereof with a colorant dispersion and an alkali halide, and wherein the first aggregation is accomplished by the mixing and heating of said sulfonated polyester and a dicationic salt, or alkali halide; a process wherein the colorant is a pigment; a process wherein the colorant is a pigment or a dye, and the alkali halide is magnesium chloride; a process wherein (i) said sulfonated polyester is dispersed in water, which water is at a temperature of from about 40° C. to about 95° C., or between about 5° C. to about 15° C. above the polyester polymer glass transition, and which dispersing is accomplished by a high speed shearing polytron device operating at speeds of from about 100 to about 5,000 revolutions per minute thereby enabling the formation of submicron sized particles;

(ii) accomplishing an initial aggregation of the dispersed sulfonated polyester particles to larger submicron particles of from about 50 to about 200 nanometers by the addition of a solution containing a monocationic salt, a dicationic salt, or an electrolyte solution;

(iii) adding a colorant dispersion with from about 20 to about 50 weight percent of predispersed colorant in water with a mean colorant size in the range of from about 50 to about 150 nanometers, and which dispersion is further diluted with deionized water, and controlling the aggregation rate by the dropwise addition of said salt, or said electrolyte, and then heating near the aggregation temperature of from about 40° C. to about 60° C. until toner sized aggregates are obtained as monitored by both optical microscopy and Coulter Counter particle size measurements; cooling; and (iv) recovering said toner composition, or said toner particles;

(v) drying said toner particles; and (vi) optionally adding to said dry toner particles, or toner of resin and colorant, wax, charge additives, and surface flow additives; a process wherein the colorant is a cyan, black, magenta, yellow dispersion or mixtures thereof with from about 20 to about 60 weight percent solids of colorant; a process wherein the sulfonated polyester is of the formula

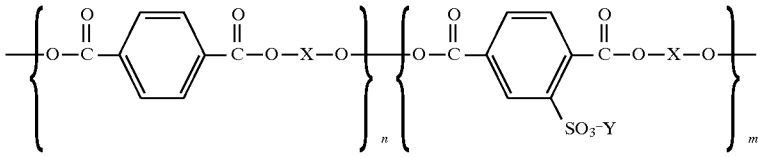

wherein Y is an alkali metal, X is a glycol, and n and m represent the number of segments; a process wherein the glycol is neopentyl glycol, ethylene glycol, propylene glycol, butylene glycol, propanediol, diethylene glycol, or mixtures thereof; a process wherein the first aggregation is accomplished by heating; a process wherein the first aggregation is accomplished by increasing the ionic strength of the sulfonated polyester by the addition of a monocationic salt; a process wherein the salt is sodium chloride; a process wherein the sulfonated polyester is a dispersion comprised of from about 5 to about 30 weight percent solids, and the colorant dispersion contains from about 20 to about 50 weight percent of colorant; a process 2 wherein the sulfonated polyester has a degree of sulfonation of from about 2.5 to about 20 mol percent; a process wherein the sulfonated polyester has a degree of sulfonation of from about 5 to about 10 mol percent; a process wherein there is obtained a colored toner with a narrow GSD in the range of from about 1.18 to about 1.28; a process wherein the alkali halide is beryllium chloride, beryllium bromide, beryllium iodide, magnesium chloride, magnesium bromide, magnesium iodide, calcium chloride, calcium bromide, calcium iodide, strontium chloride, strontium bromide, strontium iodide, barium chloride, barium bromide, or barium iodide; and the concentration thereof is optionally in the range of from about 0.1 to about 5 weight percent; a process wherein the toner particle size is from about 3 to about 7 microns in volume average diameter; a process wherein said toner is isolated, filtered, washed with water, and dried; a process wherein there is added to the surface of the formed toner of sulfonated polyester and colorant, metal salts, metal salts of fatty acids, silicas, metal oxides, or mixtures thereof, each in an amount of from about 0.1 to about 10 weight percent of the obtained toner; a process wherein the particle size of the dispersed sulfonated polyester (ii) is from about 5 to about 200 nanometers; a process wherein the polyester is random sulfonated copolyester comprised of, on a mol percent basis of the polymer repeat unit, approximately 0.47 of terephthalate/0.03 of sodium sulfoisophthalate/0.475 of 1,2 propanediol/0.025 of diethylene glycol, and which polyester possesses an $M_w$ of about 3,790, an $M_n$ of about 2,560, and a Tg of about 54.6° C.; a process wherein the halide is chloride, bromide, iodide, or fluoride; a process for the preparation of toner which comprises a (1) first aggregation of resin particles, and thereafter a (2) second aggregation thereof with a colorant and an alkali halide, and wherein the first aggregation is accomplished by the heating of said resin and said alkali halide; a process wherein for said first aggregation there is added an alkali halide; and a process wherein said resins are sulfonated polyester particles of (1) are submicron in size, and heating involves a first heating to enable aggregation, and a second heating to enable coalescence of the toner aggregates formed.

The sulfonated polyester as illustrated in the copending application, or patents recited herein is, for example, of the formula

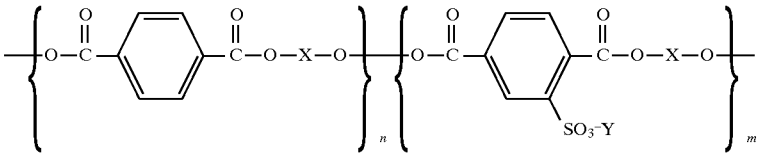

wherein Y is an alkali metal, such as a sodium; X is a glycol, such as an aliphatic glycol, or mixture of glycols, such as neopentyl glycol, ethylene glycol, propylene glycol, butylene glycol, pentylene glycol, propanediol, especially 1,2-propanediol, diethylene glycol, or mixtures thereof; and n and m represent the number of segments.

In embodiments, the first aggregation can be accomplished by an increase in the heating temperature of from about 2° to about 10° C.; the first aggregation can be accomplished by increasing the ionic strength from, for example, about 0.001 to about 5 and preferably from about 0.01 to about 2 Molar ionic strength (determined by known methods, and more specifically, see copending application U.S. Ser. No. (not yet assigned—D/97298), the disclosure of which is totally incorporated herein by reference, of the sulfonated polyester by the addition of, for example, a dicationic salt; wherein the salt selected is magnesium chloride; the sulfonated polyester is a dispersion comprised of about 5 to about 30 weight percent of solids, and the colorant dispersion is comprised of pigment containing, for example, from about 20 to about 50 percent solids; the sulfonated polyester possesses a degree of sulfonation of from about 2.5 to about 20, or from about 4 to about 15 mol percent; the sulfonated polyester possesses a degree of sulfonation of from about 5 to about 10 mol percent; the alkali metal halide is comprised of an alkali metal halide, such as for example beryllium chloride, beryllium bromide, beryllium iodide, magnesium chloride, magnesium bromide, magnesium iodide, calcium chloride, calcium bromide, calcium iodide, strontium chloride, strontium bromide, strontium iodide, barium chloride, barium bromide, barium iodide, and the like, and the concentration thereof is optionally in the range of from about 0.1 to about 5 weight percent; the toner particle size is from about 3 to about 7 microns in volume average diameter; the toner is filtered, washed with water, and dried; there is added to the surface of the formed toner of sulfonated polyester and colorant, metal salts, metal salts of fatty acids, silicas, metal oxides, or mixtures thereof, each in an amount of from about 0.1 to about 10 weight percent; and the polyester is random sulfonated copolyester comprised of, on a mol percent basis of the polymer repeat unit, approximately 0.47 of terephthalate/0.03 of sodium sulfoisophthalate/0.475 of 1,2 propanediol/0.025 of diethylene glycol, and which polyester possesses an $M_w$ of about 3,790, an $M_n$ of about 2,560, and a Tg of about 54.6° C.

The initial aggregation, or preaggregation can be accomplished by the addition of, for example, a dicationic salt to a previously dispersed sulfonated polyester in an effective amount, for example a salt amount of from about 0.05 to about 5, and preferably from about 0.05 to about 1 part or weight percent based on the amount of total components of polyester and salt; or alternatively the initial aggregation can be achieved by an increase in ionic strength from about 0.001M to about 2M (molar) by the addition of from about 1 to about 50 milliliters of a neutral monocationic salt, such as sodium chloride; or wherein the initial aggregation can be achieved by the use of an electrolyte solution of, for example, Isotone II (Coulter Electronics) in an amount of from about 30 milliliters to about 50 milliliters; and heating, for example, at a temperature of from about 40° C. to about 60° C., and preferably from about 40° C. to about 45° C. More specifically, the initial aggregation can be accomplished in embodiments as follows: dispersing between about 50 and about 200 grams of the sulfonated polyester resin in water to yield an about 5 to an about 40 weight and preferably a 20 weight percent of solids, which water is at a temperature of from about 40° C. to about 95° C., and which dispersing is accomplished by a high speed shearing polytron device operating at speeds of from about 100 to about 5,000 revolutions per minute thereby enabling the formation of submicron sized particles, and which particles are of a volume average diameter of from about 5 to about 80 nanometers; optionally followed by the controlled addition of a small amount (between 1 to 50 milliliters) of a 1 weight percent solution containing an alkali salt or alternatively an electrolyte solution, which upon heating the sulfonated polyester/coagulate solution to between about 40° C. and about 60° C. and preferably between about 40° C. and about 45° C. until an average volume particle size of between about 150 to about 300 nanometers, and preferably between about 160 to about 250 nanometers are obtained. Aggregate growth of the latex can be monitored by the particle size growth observed in a Nicomp Particle sizer, and the visible observable size increase with a optical microscope. The latex dispersion changes from a nearly transparent blue-hued solution to a visibly white latex. The advantage of an initial aggregation primarily assures control of the aggregate growth, and control and stability of the aggregation in the colorant, such as pigment, since, for example, the particle sizes of the latex and pigment are similar.

In the second aggregation, the predispersed polyester obtained from the first or preaggregation step and a colorant, especially a pigment dispersion, are further aggregated by the use of an alkali halide, such as magnesium chloride. This can be achieved by adding the colorant dispersion to the mixture and controlling the aggregation rate by the controlled addition of dicationic salt, such as $MgCl_2$, with heating between about 40° C. to about 60° C. and preferably between about 48° C. to about 52° C. until optimum toner sized aggregates are obtained. The toner particles are recovered preferably by filtration, followed by vacuum drying the toner particles, and thereafter optionally adding to the dry toner comprised of resin and colorant, known toner additives, such as charge additives, surface flow additives, and the like.

Embodiments of the present invention include a process for the preparation of toner particles comprised of resin and colorant, such as pigment, and which process comprises an initial aggregation of the dispersed sulfonated polyester particles to a size similar to the dispersed pigmented particles, followed by a second aggregation to provide particles of about 5 to about 7 microns in size diameter; a process for the preparation of toner compositions by a stepwise aggregation comprising:

i) dispersing the sulfonated polyester resin in water, which water is at a temperature of from about 40° C. to about 95° C., and which dispersing is accomplished by a high speed shearing polytron device operating at speeds of from about 100 to about 5,000 revolutions per minute thereby enabling the formation of submicron sized particles, and which particles are of a volume average diameter of from about 5 to about 80 nanometers;

ii) an initial aggregation of the dispersed sulfonated polyester particles to larger submicron particles above (i) of from about 50 to about 300 nanometers and preferably between about 100 to about 250 nanometers by the addition of a small (1 to 20 weight percent of the original solution) amount of a solution containing a mono- or dicationic salt, or an electrolyte solution of, for example, Isotone II;

iii) adding a pigment dispersion to the mixture resulting and controlling the aggregation rate by, for example, the controlled addition of dicationic salt, such as $MgCl_2$, and with heating from about 40° C. to about 60° C., and preferably between about 48° C. to about 52° C., and until toner sized aggregates are obtained;

iv) optionally, but preferably recovering the toner composition, or particles by, for example, known methods, such as filtration;

v) drying the toner particles with, for example, a vacuum; and vi) optionally adding to the dry toner particles, or toner of resin and colorant toner additives, such as charge additives, surface flow additives, and the like.

Various known colorants, especially pigments, present in the toner in an effective amount of, for example, from about 1 to about 65, preferably from about 2 to about 35 percent by weight of the toner, and more preferably in an amount of from about 1 to about 15 weight percent, include carbon black like REGAL 330®; magnetites, such as Mobay magnetites M08029™, MO8060™; and the like. As colored pigments, there can be selected known cyan, magenta, yellow, red, green, brown, blue or mixtures thereof. Specific examples of colorants, especially pigments, include phthalocyanine HELIOGEN BLUE L6900™, D6840™, D7080™, D7020™, cyan 15:3, magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of specific cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative specific examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SEIGLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The colorants, such as pigments, selected can be flushed pigments as indicated herein and not dry pigments.

More specifically, colorant examples include Pigment Blue 15:3 having a Color Index Constitution Number of 74160, magenta Pigment Red 81:3 having a Color Index Constitution Number of 45160:3, and Yellow 17 having a Color Index Constitution Number of 21105.

Colorants include pigments, dyes, mixtures of pigments, mixtures of dyes, and mixtures of dyes and pigments, and the like, and preferably pigments.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surface additives that can be added to the toner compositions after washing or drying include, for example, metal salts, metal salts of fatty acids, colloidal silicas, metal oxides like titanium, tin and the like, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and flow aids, such as fumed silicas like AEROSIL R972® available from Degussa, or silicas available from Cabot Corporation or Degussa Chemicals, each in amounts of from 0.1 to 2 percent, which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXPERIMENTAL

Preparation of Sulfonated Polyesters:

Preparation of Linear Moderately Sulfonated Polyester A (DF209):

A linear sulfonated random copolyester resin comprised of, on a mol percent, approximately 0.47 of terephthalate, 0.030 of sodium sulfoisophthalate, 0.455 of neopentyl glycol, and 0.045 of diethylene glycol was prepared as follows. In a one liter Parr reactor equipped with a bottom drain valve, double turbine agitator, and distillation receiver with a cold water condenser were charged 388 grams of dimethylterephthalate, 44.55 grams of sodium dimethylsulfoisophthalate, 310.94 grams of neopentyl glycol (1 mole excess of glycols), 22.36 grams of diethylene glycol (1 mole excess of glycols), and 0.8 gram of butyltin hydroxide oxide as the catalyst. The reactor was then heated to 165° C. with stirring for 3 hours whereby 115 grams of distillate were collected in the distillation receiver, and which distillate was comprised of about 98 percent by volume of methanol and 2 percent by volume of neopentylglycol as measured by the ABBE refractometer available from American Optical Corporation. The resulting mixture was then heated to 190° C. over a one hour period, after which the pressure was slowly reduced from atmospheric pressure to about 260 Torr over a one hour period, and then reduced to 5 Torr over a two hour period with the collection of approximately 122 grams of distillate in the distillation receiver, and which distillate was comprised of approximately 97 percent by volume of neopentylglycol and 3 percent by volume of methanol as measured by the ABBE refractometer. The pressure was then further reduced to about 1 Torr over a 30 minute period whereby an additional 16 grams of neopentylglycol were collected. The reactor was then purged with nitrogen to atmospheric pressure, and the polymer discharged through the bottom drain onto a container cooled with dry ice to yield 460 grams of the 3.0 mol percent sulfonated polyester resin, copoly(neopentylene-diethylene)terephthalate-copoly(sodium sulfoisophthalate dicarboxylate). The sulfonated polyester resin glass transition temperature was measured to be 54.7° C. (onset) utilizing the 910 Differential Scanning Calorimeter available from E. I. DuPont operating at a heating rate of 10° C. per minute. The sulfonated polyester product number average molecular weight was measured to be 2,560 grams per mole, and the weight average molecular weight was measured to be 3,790 grams per mole using tetrahydrofuran as the solvent. A particle size of 31 nanometers (volume weighted) was measured using a Nicomp particle sizer.

Preparation of Linear Moderately Sulfonated Polyester B (DF210):

A linear sulfonated random copolyester resin comprised of, on a mol percent, approximately 0.465 of terephthalate, 0.035 of sodium sulfoisophthalate, 0.475 of 1,2-propanediol, and 0.025 of diethylene glycol was prepared as follows. In a one liter Parr reactor equipped with a bottom drain valve, double turbine agitator, and distillation receiver with a cold water condenser were charged 388 grams of dimethylterephthalate, 44.55 grams of sodium dimethylsulfoisophthalate, 310.94 grams of 1,2-propanediol (1 mole excess of glycols), 22.36 grams of diethylene glycol (1 mole excess of glycols), and 0.8 gram of butyltin hydroxide oxide as the catalyst. The reactor was then heated to 165° C. with stirring for 3 hours whereby 115 grams of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 122 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 16 grams of 1,2-propanediol were collected. The reactor was then purged with nitrogen to atmospheric pressure, and the polymer discharged through the bottom drain onto a container cooled with dry ice to yield 460 grams of the 3.5 mol percent sulfonated polyester resin, copoly(1,2-propylene-diethylene)terephthalate-copoly (sodium sulfoisophthalate dicarboxylate). The sulfonated polyester resin glass transition temperature was measured to be 59.5° C. (onset) utilizing the 910 Differential Scanning Calorimeter available from E.I. DuPont operating at a heating rate of 10° C. per minute. The sulfonated polyester product number average molecular weight was measured to be 3,250 grams per mole, and the weight average molecular weight was measured to be 5,290 grams per mole using tetrahydrofuran as the solvent. A particle size of 57 nanometers (volume weighted) was measured using a Nicomp particle sizer.

Preparation of Latex Stock Solutions:

Submicron dispersions of the appropriate sulfonated polyester, such as those prepared above, in distilled deionized water were prepared by first heating the water to 10° C. to 15° C. above the glass transition of the sulfonated polyester polymer and then slowly adding the polymer with stirring until it has fully dispersed. The latexes usually had a characteristic blue tinge and particle sizes in the range of from about 5 to about 150 nanometers. Stock solutions are stable indefinitely.

Preparation of Chemical Toners via a Stepwise Aggregation Process

EXAMPLE I

An Emulsion Aggregation Stepwise Procedure to Prepare a Cyan Chemical Toner with $MgCl_2$:

A 150 milliliter solution of Latex A containing 20 percent by weight of predispersed sulfonated polyester solids with the polyester A (DF209) prepared above and a particle size of 31 nanometers was introduced into a 1 liter reaction kettle, along with 70 milliliters of a 1 percent solution of $MgCl_2$ in distilled deionized water. The reaction kettle was heated to about 45° C. for 3 hours. The particle size of the latex had grown from 31 to 120 nanometers. The growth of the particles was also apparent by the transition from a nearly clear blue tinged solution to visible white submicron latex particles. 3.0 Grams of the cyan dispersion (Sun Chemical 40 percent solids), mean pigment size of 90 nanometers, was further dispersed with 150 milliliters of distilled deionized water and was then added to the above latex particles. Fifty (50) additional milliliters of the 1 percent $MgCl_2$ were then added dropwise to the solution and the temperature retained at about 50° C. for 5 hours. The growth in pigmented particles was clearly visible in a laboratory microscope and the particle size, as measured on a Coulter Counter, was 3.0 microns. An additional 20 milliliters of the 1 percent $MgCl_2$ solution were added dropwise and the temperature increased to 52° C. After 2 hours, a sample of about 5 grams was removed and observed under a microscope, and there were revealed spherical toner particles containing both pigment and polymer. A final cyan toner, particle size of 5.0 microns with a GSD of 1.3, resulted with the toner being comprised of 96.25 weight percent of the sulfonated polyester A (DF209) and 3.5 weight percent of the cyan pigment.

EXAMPLE II

An Emulsion Aggregation Stepwise Procedure to Prepare a Cyan Chemical Toner with Electrolyte and $MgCl_2$:

A 150 milliliter solution of Latex A containing 20 percent by weight of predispersed sulfonated polyester B (DF210) prepared above solids and a particle size of 31 nanometers was introduced into an one liter reaction kettle, along with 30 milliliters of Isotone II (a coulter electrolyte solution). The reaction kettle was heated to about 45° C. for 3 hours. The particle size of the latex grew from 31 nanometers to 120 nanometers. The growth of the particle was also apparent by the transition from a nearly clear blue tinged solution to visible white submicron latex particles. 3.0 Grams of the cyan dispersion (Sun Chemical 40 percent solids), with a mean pigment size of 90 nanometers, were further dispersed with a 150 milliliters of distilled deionized water, and then added to the above Latex A particles. 50 Milliliters of the 1 percent $MgCl_2$ were added dropwise to the resulting solution and the temperature retained at about 50° C. for a period of 11.75 hours. The growth in pigmented particles was clearly visible in a laboratory microscope and the particle size, as measured on a Coulter Counter, was 2.7 microns. An additional 15 milliliters of the 1 percent $MgCl_2$ solution were added dropwise and the temperature increased to 52° C. After 2 hours, a sample was removed and observed under a microscope which revealed spherical particles containing both pigment and polymer. A final cyan toner with a particle size of 4.1 microns and a GSD of 1.2 was obtained, and which toner was comprised of 96.25 weight percent of the sulfonated polyester A (DF210) and 3.5 weight percent of the cyan pigment.

EXAMPLE III

An Emulsion Aggregation Stepwise Procedure to Prepare a Cyan Chemical Toner with NaCl and $MgCl_2$:

A 150 milliliter solution of Latex A containing 20 percent by weight of predispersed sulfonated polyester A (DF209) or B (DF210) prepared above solids and a particle size of 31 nanometers was introduced into a 1 liter reaction kettle along with 31 milliliters of a 1 weight percent NaCl solution. The reaction kettle was heated to about 45° C. for 3 hours. The particle size of the latex grew from 30 to 120 nanometers. The growth of the particle was also apparent by the transition from a nearly clear blue tinged solution to visible white submicron latex particles. 3.0 Grams of the cyan dispersion (Sun Chemical 40 percent solids), mean pigment size of 90 nanometers, was further dispersed with 150 milliliters of distilled deionized water and was then added to the above latex particles. 50 Milliliters of the 1 percent $MgCl_2$ were added dropwise to the resulting solution and the temperature held between 45° C. to 50° C. for a period of 11.75 hours. The growth in pigmented particles was clearly visible in a laboratory microscope and the particle size, as measured on a Coulter Counter, was 2.7 microns. An additional 15 milliliters of the 1 percent $MgCl_2$ solution was added dropwise and the temperature increased to 52° C. After 2 hours, a sample was removed and observed under a microscope which revealed spherical particles containing both pigment and polymer. A final cyan toner, particles size of 4.1 microns and a GSD of 1.2, was obtained with the toner being comprised of 96.25 weight percent of the sulfonated polyester and 3.5 weight percent of the cyan pigment.

EXAMPLE IV

An Emulsion Aggregation Stepwise Procedure to Prepare a Magenta Chemical Toner with $MgCl_2$:

A 150 milliliter solution of Latex A containing 20 percent by weight of predispersed sulfonated polyester A (DF209) or B (DF210) prepared above solids and a particle size of 31 nanometers was introduced into a 1 liter reaction kettle along with 70 milliliters of a 1 percent solution of $MgCl_2$ in distilled deionized water. The reaction kettle was heated to about 45° C. for 3 hours. The particle size of the latex had grown from 31 to 120 nanometers. The growth of the particles was also apparent by the transition from a nearly clear blue tinged solution to visible white submicron latex particles. 3.0 Grams of the magenta dispersion (Sun Chemical 40 percent solids), with a mean pigment size of 80 nanometers, were further dispersed with 150 milliliters of distilled deionized water and then added to the above latex particles. Fifty more milliliters of the 1 percent $MgCl_2$ were added dropwise to the resulting solution and the temperature held at about 50° C. for 5 hours. The growth in pigmented particles was clearly visible in a laboratory microscope and the particle size, as measured on a Coulter Counter, was 3.0 microns. An additional 20 milliliters of the 1 percent $MgCl_2$ solution were added dropwise and the temperature increased to 52° C. After 2 hours, a sample, about 10 grams, was removed and observed under a microscope which revealed spherical particles containing both pigment and polymer. A final magenta toner with a particle size of 5.0 microns and a GSD of 1.3 resulted. The aforementioned resulting toner was comprised of 95.0 weight percent of the sulfonated polyester and 5.0 weight percent of the magenta pigment.

EXAMPLE V

An Emulsion Aggregation Stepwise Procedure to Prepare a Magenta Chemical Toner with Electrolyte and $MgCl_2$:

A 150 milliliter solution of Latex A containing 20 percent by weight of predispersed sulfonated polyester A (DF209) or B (DF210) prepared above solids and a particle size of 31 nanometers was introduced into a 1 liter reaction kettle along with 30 milliliters of Isotone II (a coulter electrolyte solution). The reaction kettle was heated to about 45° C. for 3 hours. The particle size of the latex grew from 31 to 120 nanometers. The growth of the particle was also apparent by the transition from a nearly clear blue tinged solution to visible white submicron latex particles. 3.0 Grams of the magenta dispersion (Sun Chemical 40 percent solids), with a mean pigment size of 90 nanometers, further dispersed with 150 milliliters of distilled deionized water were then added to the above latex particles. 50 Milliliters of the 1 percent $MgCl_2$ were added dropwise to the solution and the temperature held to about 50° C. for a period of 11.75 hours. The growth in pigmented particles was clearly visible in a laboratory microscope and the particle size, as measured on a Coulter Counter, was 2.7 microns. An additional 15 milliliters of the 1 percent $MgCl_2$ solution were added dropwise and the temperature increased to 52° C. After 2 hours, a sample was removed and observed under a microscope which revealed spherical particles containing both pigment and polymer. A final magenta toner with a size of 4.1 microns and a GSD of 1.2 was obtained, and wherein the toner was comprised of 95.0 weight percent of the sulfonated polyester and 5.0 weight percent of magenta pigment.

EXAMPLE VI

An Emulsion Aggregation Stepwise Procedure to Prepare a Magenta Chemical Toner with NaCl and $MgCl_2$:

A 150 milliliter solution of Latex A containing 20 percent by weight of predispersed sulfonated polyester A (DF209) or B (DF210) prepared above solids and a particle size of 30 nanometers was introduced into a 1 liter reaction kettle along with 30 milliliters of a one weight percent NaCl solution. The reaction kettle was heated to about 45° C. for 3 hours. The particle size of the latex grew from 30 to 120 nanometers. The growth of the particles were also apparent by the transition from a nearly clear blue tinged solution to visible white submicron latex particles. 3.0 Grams of the magenta dispersion (Sun Chemical 40 percent solids) with a mean pigment size of 90 nanometers further dispersed with a 150 milliliters of distilled deionized water were then added to the latex particles. 50 Milliliters of the 1 percent $MgCl_2$ were added dropwise to the resulting solution and the temperature held at about 50° C. for a period of 11.75 hours. The growth in pigmented particles was clearly visible in a laboratory microscope and the particle size, as measured on a Coulter Counter, was 2.7 microns. An additional 15 milliliters of the 1 percent $MgCl_2$ solution was added dropwise and the temperature increased to 52° C. After 2 hours, a sample was removed and observed under a microscope which revealed spherical particles containing both pigment and polymer. A final magenta toner particle size of 4.1 microns with a GSD of 1.2 was obtained, and wherein the toner was comprised of 95.0 weight percent of the sulfonated polyester and 5.0 weight percent of the magenta pigment.

EXAMPLE VII

An Emulsion Aggregation Stepwise Procedure to Prepare a Black Chemical Toner with $MgCl_2$:

A 150 milliliter solution of Latex A containing 20 percent by weight of predispersed sulfonated polyester A (DF209) or B (DF210) prepared above solids and a particle size of 31 nanometers was introduced into a 1 liter reaction kettle along with 70 milliliters of a 1 percent solution of $MgCl_2$ in distilled deionized water. The reaction kettle was heated to about 45° C. for 3 hours. The particle size of the latex had grown from 31 to 120 nanometers. The growth of the particle was also apparent by the transition from a nearly clear blue tinged solution to visible white submicron latex particles. 3.0 Grams of the black dispersion (Sun Chemical 40 percent solids) with a mean pigment size of 90 nanometers further were dispersed with 150 milliliters of distilled deionized water and then added to the latex particles. Fifty more milliliters of the 1 percent $MgCl_2$ were added dropwise to the solution and the temperature held at about 50° C. for 5 hours. The growth in pigmented particles was clearly visible in a laboratory microscope and the particle size, as measured on a Coulter Counter, was 3.0 microns. An additional 20 milliliters of the 1 percent $MgCl_2$ solution were added dropwise and the temperature increased to 52° C. After 2 hours, a sample was removed and observed under a microscope which revealed spherical particles containing both pigment and polymer. A final black toner particle size of 5.0 microns with a GSD of 1.3 was obtained, and which toner was comprised of 94.0 weight percent of the sulfonated polyester and 6.0 weight percent of the above black pigment.

EXAMPLE VIII

An Emulsion Aggregation Stepwise Procedure to Prepare a Black Chemical Toner with Electrolyte and $MgCl_2$:

A 150 milliliter solution of Latex A containing 20 percent by weight of predispersed sulfonated polyester A (DF209) or B (DF210) prepared above solids and a particle size of 31 nanometers was introduced into a 1 liter reaction kettle along with 30 milliliters of Isotone II (a coulter electrolyte solution). The reaction kettle was heated to about 45° C. for 3 hours. The particle size of the latex grew from 31 to 120 nanometers. The growth of the particle was also apparent by the transition from a nearly clear blue tinged solution to visible white submicron latex particles. 3.0 Grams of the yellow dispersion (Sun Chemical 40 percent solids) with a mean pigment size of 90 nanometers were further dispersed with 150 milliliters of distilled deionized water and then added to the latex particles. 50 Milliliters of the 1 percent $MgCl_2$ were added dropwise to the solution and the temperature held at about 50° C. for a period of 11.75 hours. The growth in pigmented particles was clearly visible in a laboratory microscope and the particle size, as measured on a Coulter Counter, was 2.7 microns. An additional 15 milliliters of the 1 percent $MgCl_2$ solution were added dropwise and the temperature increased to 52° C. After 2 hours, a sample was removed and observed under a microscope which revealed spherical particles containing both pigment and polymer. A final black toner particle size of 4.1 microns in volume average throughout and as determined by a Coulter Counter with a GSD of 1.2 was observed, and this toner contained 94.0 weight percent of the sulfonated polyester and 6.0 weight percent of black pigment.

EXAMPLE IX

An Emulsion Aggregation Stepwise Procedure to Prepare a Black Chemical Toner with NaCl and $MgCl_2$:

A 150 milliliter solution of Latex A containing 20 percent by weight of predispersed sulfonated polyester A (DF209) prepared above solids and a particle size of 31 nanometers was introduced into a 1 liter reaction kettle together with 30 milliliters of a one weight percent NaCl solution. The reaction kettle was heated to about 45° C. for 3 hours. The particle size of the latex grew from 31 to 120 nanometers. The growth of the particles was also apparent by the transition from a nearly clear blue tinged solution to visible white submicron latex particles. 3.0 Grams of the black dispersion (Sun Chemical 40 percent solids) with a mean pigment size of 90 nanometers were further dispersed with 150 milliliters of distilled deionized water and then added to the latex particles. 50 Milliliters of the 1 percent $MgCl_2$ were added dropwise to the solution and the temperature held at about 50° C. for a period of 11.75 hours. The growth in pigmented particles was clearly visible in a laboratory microscope and the particle size, as measured on a Coulter Counter, was 2.7 microns. An additional 15 milliliters of the 1 percent $MgCl_2$ solution were added dropwise and the temperature increased to 52° C. After 2 hours, a sample was removed and observed under a microscope which revealed spherical particles containing both pigment and polymer. A final black toner particle size of 4.1 microns with a GSD of 1.2 was observed. This toner contained 94.0 weight percent of the sulfonated polyester and 6.0 weight percent of black pigment.

EXAMPLE X

An Emulsion Aggregation Stepwise Procedure to Prepare a Yellow Chemical Toner with $MgCl_2$:

A 150 milliliter solution of Latex A containing 20 percent by weight of predispersed sulfonated polyester A (DF209) prepared above solids and a particle size of 31 nanometers was introduced into a 1 liter reaction kettle along with 70 milliliters of a 1 percent solution of $MgCl_2$ in distilled deionized water. The reaction kettle was heated to about 45° C. for 3 hours. The particle size of the latex had grown from 31 to 120 nanometers. The growth of the particles was also apparent by the transition from a nearly clear blue tinged solution to visible white submicron latex particles. 3.0 Grams of the yellow dispersion (Sun Chemical 40 percent solids) with mean pigment size of 90 nanometers were further dispersed with a 150 milliliters of distilled deionized water and then added to the latex particles. Fifty more milliliters of the 1 percent $MgCl_2$ were added dropwise to the solution and the temperature held at about 50° C. for 5 hours. The growth in pigmented particles was clearly visible in a laboratory microscope and the particle size, as measured on a Coulter Counter, was 3.0 microns. An additional 20 milliliters of the 1 percent $MgCl_2$ solution were added dropwise and the temperature increased to 52° C. After 2 hours, a sample was removed and observed under a microscope which revealed spherical particles containing both pigment and polymer. A final yellow toner particle size of 5.0 microns with a GSD of 1.3 was observed, and the toner contained 92.0 weight percent of the sulfonated polyester and 8.0 weight percent of yellow pigment.

EXAMPLE XI

An Emulsion Aggregation Stepwise Procedure to Prepare a Yellow Chemical Toner with Electrolyte and $MgCl_2$:

A 150 milliliter solution of Latex A containing 20 percent by weight of predispersed sulfonated polyester A (DF209) prepared above solids and a particle size of 31 nanometers was introduced into a 1 liter reaction kettle along with 30 milliliters of Isotone II (a coulter electrolyte solution). The reaction kettle was heated to about 45° C. for 3 hours. The particle size of the latex grew from 31 to 120 nanometers. The growth of the particles was also apparent by the transition from a nearly clear blue tinged solution to visible white submicron latex particles. 3.0 Grams of the yellow dispersion (Sun Chemical 40 percent solids) whose mean pigment size of 90 nanometers was further dispersed with a 150 milliliters of distilled deionized water and then added to the latex particles. 50 Milliliters of the 1 percent $MgCl_2$ were added dropwise to the solution and the temperature held at about 50° C. for a period of 11.75 hours. The growth in pigmented particles was clearly visible in a laboratory microscope and the particle size, as measured on a Coulter Counter, was 2.7 microns. An additional 15 milliliters of the 1 percent $MgCl_2$ solution were added dropwise and the temperature increased to 52° C. After 2 hours, a sample was removed and observed under a microscope which revealed spherical particles containing both pigment and polymer. A final yellow toner with a particle size of 4.1 microns and a GSD of 1.2 was observed, and wherein this yellow toner contained 92.0 weight percent of the sulfonated polyester and 8.0 weight percent of yellow pigment.

EXAMPLE XII

An Emulsion Aggregation Stepwise Procedure to Prepare a Yellow Chemical Toner with NaCl and $MgCl_2$:

A 150 milliliter solution of Latex A containing 20 percent by weight of predispersed sulfonated polyester A (DF209) prepared above solids and a particle size of 31 nanometers was introduced into a 1 liter reaction kettle, along with 30 milliliters of a one weight percent NaCl solution. The reaction kettle was heated to between 50° C. to 52° C. for 3 hours. The particle size of the latex increased from 31 to 120 nanometers. The growth of the particles was also apparent by the transition from a nearly clear blue tinged solution to visible white submicron latex particles. 3.0 Grams of the yellow dispersion (Sun Chemical 40 percent solids) with a mean pigment size of 90 nanometers was further dispersed with a 150 milliliters of distilled deionized water and was then added to the latex particles. 50 Milliliters of the 1 percent $MgCl_2$ were added dropwise to the solution and the temperature held between 45° C. to 50° C. for a period of 11.75 hours. The growth in pigmented particles was clearly visible in a laboratory microscope and the particle size, as measured on a Coulter Counter, was 2.7 microns. An additional 15 milliliters of the 1 percent $MgCl_2$ solution were added dropwise and the temperature increased to 52° C. After 2 hours, a sample was removed and observed under a microscope which revealed spherical particles containing both pigment and polymer. A final yellow toner with a particle size of 4.1 microns and with a GSD of 1.2 was obtained, and which toner contained 92.0 weight percent of the sulfonated polyester and 8.0 weight percent of yellow pigment.

Other modifications of the present invention may occur to those skilled in the art subsequent to a review of the present application and these modifications, including equivalents thereof, are intended to be included within the scope of the present invention.

What is claimed is:

1. A process for the preparation of toner, which process comprises a first aggregation of submicron sulfonated polyester in the presence of an alkali halide, and thereafter a second aggregation with a colorant dispersion and an alkali halide.

2. A process for the preparation of toner, which process comprises a (1) first aggregation of dispersed submicron sulfonated polyester particles and thereafter a (2) second aggregation thereof with a colorant dispersion and an alkali halide, and wherein the first aggregation is accomplished by the mixing and heating of said sulfonated polyester and a dicationic salt, or alkali halide, and wherein said submicron is from about 5 to about 80 nanometers.

3. A process in accordance with claim 2 wherein the colorant is a pigment.

4. A process in a accordance with claim 2 wherein the colorant is a pigment or a dye, and the alkali halide is magnesium chloride.

5. A process for the preparation of toner, which process comprises a first aggregation of sulfonated polyester and thereafter a second aggregation with a colorant dispersion and an alkali halide, and wherein (i) said sulfonated polyester is dispersed in water, which water is at a temperature of from about 40° C. to about 95° C., or between about 5° C. to about 15° C. above the polyester polymer glass transition, and which dispersing is accomplished by a high speed shearing polytron device operating at speeds of from about 100 to about 5,000 revolutions per minute thereby enabling the formation of submicron sized particles;

(ii) accomplishing an initial aggregation of the dispersed sulfonated polyester particles to larger submicron particles of from about 50 to about 200 nanometers by the addition of a solution containing a monocationic salt, a dicationic salt, or an electrolyte solution;

(iii) adding a colorant dispersion with from about 20 to about 50 weight percent of predispersed colorant in water with a mean colorant size in the range of from about 50 to about 150 nanometers, and which dispersion is further diluted with deionized water, and controlling the aggregation rate by the dropwise addition of said salt, or said electrolyte, and then heating near the aggregation temperature of from about 40° C. to about 60° C. until toner sized aggregates are obtained as monitored by both optical microscopy and Coulter Counter particle size measurements; cooling; and (iv) recovering said toner composition, or said toner particles;

(v) drying said toner particles; and (vi) optionally adding to said dry toner particles, or toner of resin and colorant, wax, charge additives, and surface flow additives.

6. A process in accordance with claim 2 wherein the colorant is a cyan, black, magenta, yellow dispersion or mixtures thereof with from about 20 to about 60 weight percent solids of colorant.

7. A process in accordance with claim 2 wherein the sulfonated polyester is of the formula

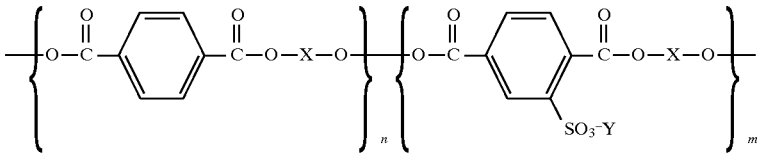

wherein Y is an alkali metal, X is a glycol, and n and m represent the number of segments.

8. A process in accordance with claim 7 wherein the glycol is neopentyl glycol, ethylene glycol, propylene glycol, butylene glycol, propanediol, diethylene glycol, or mixtures thereof.

9. A process in accordance with claim 1 wherein the first aggregation is accomplished by heating below about the sulfonated polyester glass transition temperature.

10. A process in accordance with claim 2 wherein the first aggregation is accomplished by increasing the ionic strength of the sulfonated polyester by the addition of a monocationic salt.

11. A process in accordance with claim 10 wherein the salt is sodium chloride.

12. A process in accordance with claim 2 wherein the sulfonated polyester is a dispersion comprised of from about 5 to about 30 weight percent solids, and the colorant dispersion contains from about 20 to about 50 weight percent of colorant.

13. A process in accordance with claim 2 wherein the sulfonated polyester has a degree of sulfonation of from about 2.5 to about 20 mol percent.

14. A process in accordance with claim 2 wherein the sulfonated polyester has a degree of sulfonation of from about 5 to about 10 mol percent.

15. A process in accordance with claim 1 wherein there is obtained a colored toner with a narrow GSD in the range of from about 1.18 to about 1.28.

16. A process in accordance with claim 1 wherein the alkali halide is beryllium chloride, beryllium bromide, beryllium iodide, magnesium chloride, magnesium bromide, magnesium iodide, calcium chloride, calcium bromide, calcium iodide, strontium chloride, strontium bromide, strontium iodide, barium chloride, barium bromide, or barium iodide; and the concentration thereof is optionally in the range of from about 0.1 to about 5 weight percent.

17. A process in accordance with claim 2 wherein the toner particle size is from about 3 to about 7 microns in volume average diameter.

18. A process in accordance with claim 2 wherein said toner is isolated, filtered, washed with water, and dried.

19. A process in accordance with claim 2 wherein there is added to the surface of the formed toner of sulfonated polyester and colorant, metal salts, metal salts of fatty acids, silicas, metal oxides, or mixtures thereof, each in an amount of from about 0.1 to about 10 weight percent of the obtained toner.

20. A process in accordance with claim 2 wherein the particle size of the dispersed sulfonated polyester is from about 5 to about 200 nanometers.

21. A process in accordance with claim 2 wherein the polyester is random sulfonated copolyester comprised of, on a mol percent basis of the polymer repeat unit, approximately 0.47 of terephthalate/0.03 of sodium sulfoisophthalate/0.475 of 1,2 propanediol/0.025 of diethylene glycol, and which polyester possesses an $M_w$ of about 3,790, an $M_n$ of about 2,560, and a Tg of about 54.6° C.

22. A process in accordance with claim 1 wherein the halide is chloride, bromide, iodide, or fluoride.

23. A process for the preparation of toner which comprises a (1) first aggregation of submicron resin particles in the presence of an alkali halide, and thereafter a (2) second aggregation thereof with a colorant and an alkali halide, and wherein the first aggregation is accomplished by the heating of said resin and said alkali halide.

24. A process in accordance with claim 23 wherein said micron is about 1 micron or less.

25. A process in accordance with claim 23 wherein said resins are sulfonated polyester particles of (1) are submicron in size, and wherein said submicron is from about 5 to about 80 nanometers, and heating involves a first heating to enable aggregation, and a second heating to enable coalescence of the toner aggregates formed.

26. A process in accordance with claim 2 wherein the alkali halide is magnesium chloride.

27. A process in accordance with claim 2 wherein there is further added a mono cationic salt.

28. A process in accordance with claim 27 wherein the mono cationic salt is sodium chloride.

29. A process in accordance with claim 2 wherein said submicron is from about 5 to about 80 nanometers, and said colorant in said dispersion is of a size of from about 50 to about 150 nanometers.

30. A process in accordance with claim 2 further including a third aggregation of the resulting mixture in the presence of an alkali halide.

* * * * *